US010423112B2

(12) United States Patent
Bui

(10) Patent No.: US 10,423,112 B2
(45) Date of Patent: Sep. 24, 2019

(54) SHEET FEEDING DEVICE AND IMAGE FORMING APPARATUS

(71) Applicant: KYOCERA Document Solutions Inc., Osaka (JP)

(72) Inventor: Long Dang Bui, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 49 days.

(21) Appl. No.: 15/686,277

(22) Filed: Aug. 25, 2017

(65) Prior Publication Data

US 2018/0059611 A1 Mar. 1, 2018

(30) Foreign Application Priority Data

Aug. 29, 2016 (JP) ..... 2016-166770

(51) Int. Cl.
*G03G 15/00* (2006.01)
*G03G 21/16* (2006.01)

(52) U.S. Cl.
CPC ..... *G03G 15/6555* (2013.01); *G03G 21/168* (2013.01)

(58) Field of Classification Search
CPC ..... G03G 15/6555
USPC ..... 399/392
See application file for complete search history.

(56) References Cited

U.S. PATENT DOCUMENTS 7,383,015 B2 * 6/2008 Sato ..... G03G 15/6502 399/392
7,549,631 B2 * 6/2009 Tsuchida ..... B65H 1/04 271/145
8,087,658 B2 * 1/2012 Ohtsuki ..... B65H 5/26 271/162
8,202,015 B2 * 6/2012 Peck ..... B65H 31/02 271/162
8,857,812 B2 * 10/2014 Yamamoto ..... B65H 1/04 271/162
9,272,856 B2 3/2016 Okura
(Continued)

FOREIGN PATENT DOCUMENTS

JP 2003-326801 A 11/2003
JP 2005-138971 A 6/2005
JP 2015-094888 A 5/2015

OTHER PUBLICATIONS

Office Action mailed by the Japanese Patent Office dated Apr. 9, 2019, which corresponds to Japanese Patent Application No. 2016-166770 and is related to U.S. Appl. No. 15/686,277.

*Primary Examiner* — Anthony H Nguyen
(74) *Attorney, Agent, or Firm* — Studebaker & Brackett PC

(57) ABSTRACT

A sheet feeding device includes a side face of a device body and a bypass tray. The bypass tray is supported so as to be turned around a turning fulcrum part with respect to the side face between a close position along the side face and an open position being held at a predetermined angle with respect to the side face. The bypass tray includes a facing surface and a first positioned part. The facing surface faces to the side face in the close position and is capable of stacking the sheet in the open position. The first positioned part is arranged on the facing surface below the turning fulcrum part. The side face includes a first positioning part. The first positioning part is fitted with the first positioned part in the open position to restrict movement of the bypass tray in the width direction.

18 Claims, 15 Drawing Sheets

(56) References Cited

U.S. PATENT DOCUMENTS

| | | | | |
|---|---|---|---|---|
| 2005/0220519 | A1* | 10/2005 | Mizuno | G03G 15/6514 399/392 |
| 2010/0007077 | A1* | 1/2010 | Satake | B65H 1/04 271/111 |
| 2011/0233859 | A1* | 9/2011 | Watanabe | B65H 29/52 271/271 |
| 2015/0042030 | A1* | 2/2015 | Washino | B65H 1/04 271/3.14 |

* cited by examiner

SHEET FEEDING DEVICE AND IMAGE FORMING APPARATUS

INCORPORATION BY REFERENCE

This application is based on and claims the benefit of priority from Japanese Patent application No. 2016-166770 filed on Aug. 29, 2016, the entire contents of which are incorporated herein by reference.

BACKGROUND

The present disclosure relates to a sheet feeding device including a manual bypass tray and an image forming apparatus including this sheet feeding device.

An image forming apparatus, such as a printer or a multifunction peripheral, includes a sheet feeding device including a manual bypass tray. The sheet feeding device is configured so as to feed a sheet stacked on the manual bypass tray for image forming process.

For example, in the image forming apparatus, an inversion unit may be configured to include the manual bypass tray and to be detachably attached to an apparatus body. The manual bypass tray includes a sensor sensing whether or not the sheet is stacked, and then, on the basis of this sensed result, an inversion function of the inversion unit is controlled. The manual bypass tray is concurrently used as a cover for jam treatment to be openable and closable.

The sheet feeding device including the manual bypass tray is configured so that the manual bypass tray is arranged turnable with respect to a storage recessed part provided in a front cover or the like of an apparatus body. A turning axis direction of the manual bypass tray is a width direction of the sheet (a sheet width direction) on the manual bypass tray. The manual bypass tray has positioning bosses as turning axes at both ends in the sheet width direction and the positioning bosses determine a feeding position of the sheet from the manual bypass tray. The storage recessed part has positioning holes at both ends in the sheet width direction and the positioning bosses are attached to the positioning holes. If the manual bypass tray is not used, the manual bypass tray is turned and stored in the storage recessed part.

The storage recessed part and the manual bypass tray have, for example, a length in the sheet width direction of the order of 300 mm, that is, have a relatively great size. Accordingly, if the storage recessed part and the manual bypass tray are formed without dimensional difference of overlap, it is difficult to restrain tolerance of the manual bypass tray and the storage recessed part with strict accuracy. Therefore, backlash amount in the sheet width direction (a thrust direction) may be increased, skew may occur in a case where the sheet is fed by using the manual bypass tray, the skew may be increased, and sheet feeding performance may be degraded.

SUMMARY

In accordance with an embodiment of the present disclosure, a sheet feeding device includes a side face of a device body and a bypass tray. The bypass tray is supported so as to be turned around a turning fulcrum part with respect to the side face between a close position along the side face and an open position being held at a predetermined angle with respect to the side face. The bypass tray includes a facing surface and a first positioned part. The facing surface faces to the side face in the close position and is capable of stacking the sheet in the open position. The first positioned part is arranged on the facing surface below the turning fulcrum part. The side face includes a first positioning part. The first positioning part is fitted with the first positioned part in the open position to restrict movement of the bypass tray in the width direction.

In accordance with an embodiment of the present disclosure, an image forming apparatus includes the above-described sheet feeding device, a bypass sheet feeding part provided with the sheet feeding device, and an image forming part forming an image on the sheet fed from the sheet feeding device.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

First, the entire structure of a printer 1 (an image forming apparatus) according to an embodiment of the present disclosure will be described with reference to drawings. In the embodiment, forward and backward directions of the printer 1 are a conveyance direction of a sheet (a sheet conveyance direction), and left and right directions of the printer 1 are a width direction of the sheet (a sheet width direction).

Figure 1:
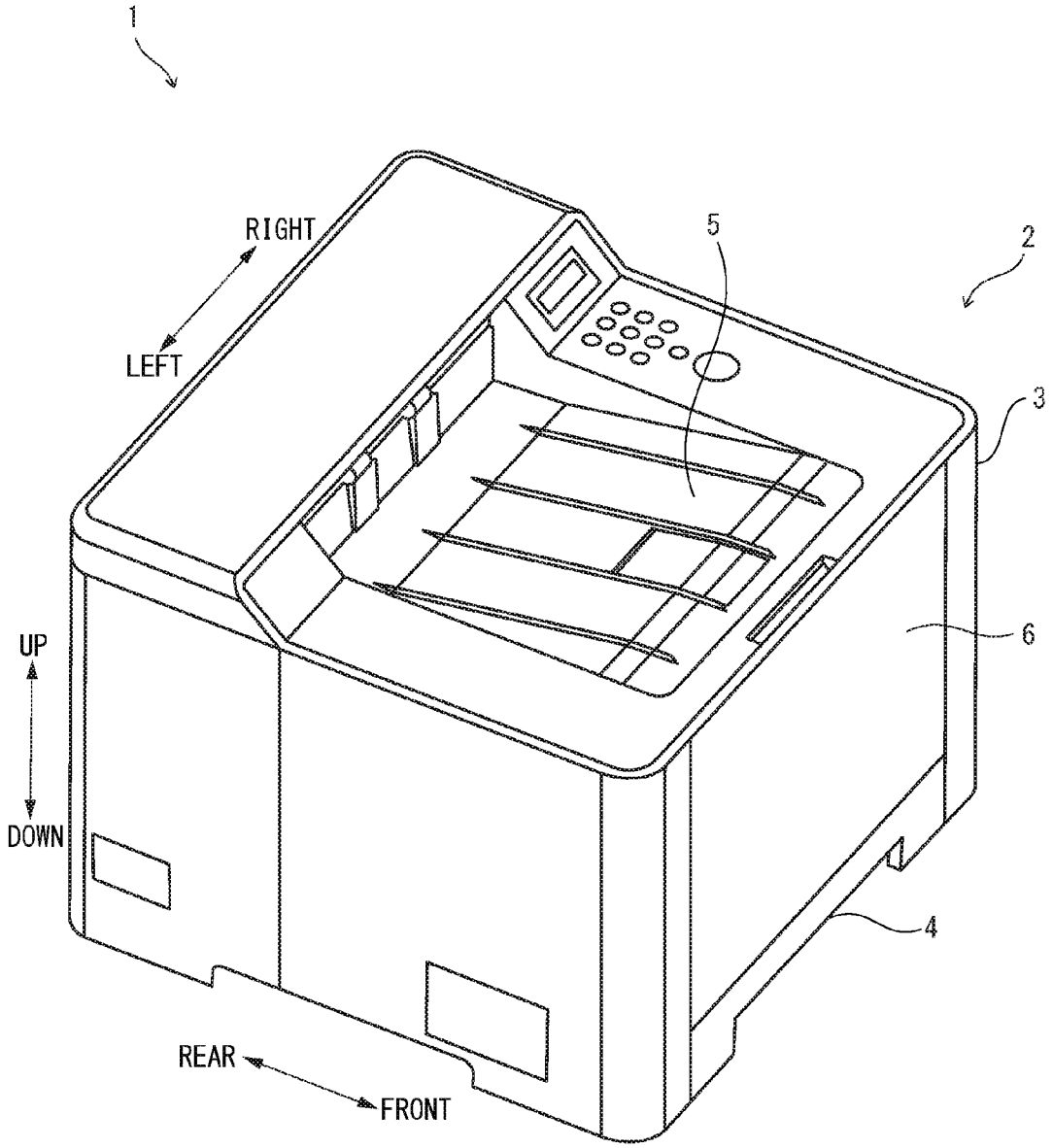
FIG. 1 is a perspective view showing a printer according to an embodiment of the present disclosure.

As shown in FIG. 1 and other figures, the printer 1 includes a box-like formed printer body 2 (an apparatus body). A front part of the printer body 2 is composed of a front cover 3 erected. The front cover 3 has a storage recessed part 3*a* recessed to a back side at the center in the left and right directions. In a lower part inside the printer body 2, a sheet feeding cartridge 4 storing the sheet is installed. In an upper end of the printer body 2, an ejected sheet tray 5 is formed. The sheet feeding cartridge 4 is configured so as to be detached and attached in the forward and backward directions via an opening below the storage recessed part 3*a* of the front cover 3.

Figure 2:
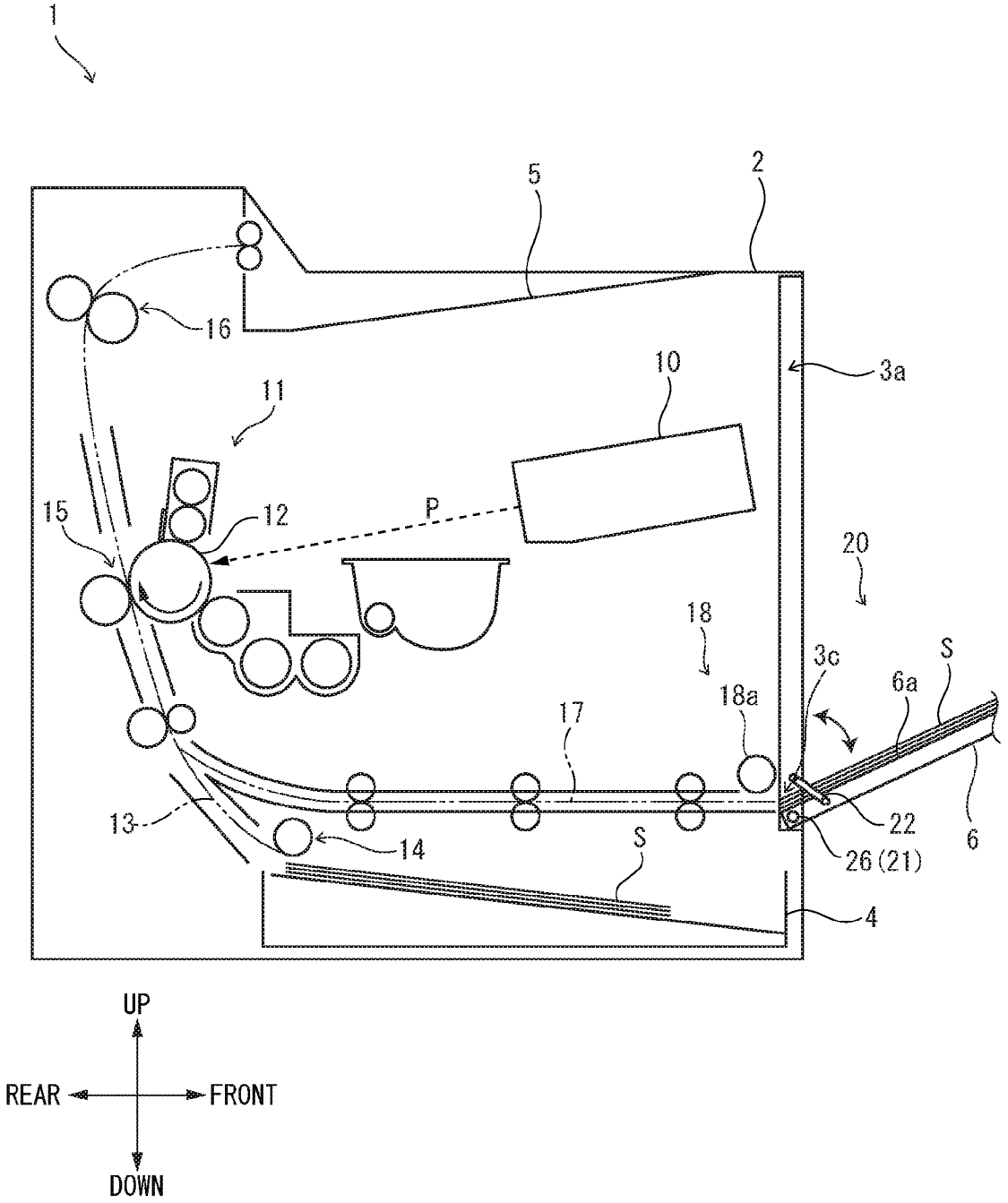
FIG. 2 is a sectional view schematically showing the printer according to the embodiment of the present disclosure.

The storage recessed part 3*a* of the front cover 3 is formed so as to be capable of storing a manual bypass tray 6 (a bypass tray). With respect to the storage recessed part 3*a*, the manual bypass tray 6 is supported so as to be turned between a close position (refer to FIG. 1) along the front cover 3 and an open position held (refer to FIG. 3) at a predetermined angle with respect to the front cover 3 and capable of stacking the sheet to be fed. For example, as shown in FIG. 2, a close direction closing the manual bypass tray 6 to the close position is a counterclockwise direction as viewed from a left side and an open direction opening the manual bypass tray 6 to the open position is a clockwise direction as viewed from the left side. The close position of the manual bypass tray 6 is a position where the manual bypass tray 6 in an erected state is stored in the storage recessed part 3*a* and the open position of the manual bypass tray 6 is a position where the manual bypass tray 6 in a laid state exposes the storage recessed part 3*a*. An outside face side of the manual bypass tray 6 at the close position composes a front face of the printer body 2 together with the front cover 3 and a front face of the sheet feeding cartridge 4. The front cover 3 and the manual bypass tray 6 will be described later in detail.

As shown in FIG. 2, inside the printer body 2, an exposure device 10 composed of a laser scanning unit (LSU) is located at a front part and an image forming part 11 is arranged at a rear part. In the image forming part 11, a photosensitive drum 12 (an image carrier) is rotatably arranged. Around the photosensitive drum 12, a charging device, a development device connected to a toner container, a transfer roller and a cleaning device are located along a rotating direction of the photosensitive drum 12.

In addition, inside the printer body 2, a first conveying path 13 for the sheet is arranged so as to convey the sheet from the sheet feeding cartridge 4 at a lower side to the ejected sheet tray 5 at an upper side via the image forming part 11. At an upstream end of the first conveying path 13, a cartridge sheet feeding part 14 is positioned. At an intermediate stream portion of the first conveying path 13, a transferring part 15 composed of the photosensitive drum 12 and the transfer roller of the image forming part 11 is positioned. At a downstream portion of the first conveying path 13, a fixing device 16 is positioned.

Further, inside the printer body 2, a second conveying path 17 for the sheet is arranged so as to convey the sheet from the manual bypass tray 6 at a front side to a rear side via an upper side of the sheet feeding cartridge 4. At an upstream end of the second conveying path 17, a manual bypass sheet feeding part 18 is positioned. A downstream end of the second conveying path 17 joins the first conveying path 13 at a downstream side from the cartridge sheet feeding part 14 and at an upstream side from the image forming part 11.

In the embodiment, a sheet feeding device 20 feeding the sheet from the manual bypass tray 6 is composed of the manual bypass sheet feeding part 18, the front cover 3 and the manual bypass tray 6. The manual bypass sheet feeding part 18 includes, for example, a sheet feeding roller 18*a* (a feeding part) feeding the sheet from the manual bypass tray 6 to the second conveying path 17 in the inside of the device (in the inside of a device body of the sheet feeding device 20) and a feeding guide 23 guiding the sheet fed by the sheet feeding roller 18*a* to the second conveying path 17 (in the inside of the device body). The storage recessed part 3*a* composes a side face (a side face of the device body) at a façade face side (a front face side) of the sheet feeding device 20 and is defined by left and right internal lateral faces 3*b* of the front cover 3. Incidentally, the feeding guide 23 will be described later.

When the manual bypass tray 6 is turned to the open position (refer to FIG. 3) or the manual bypass tray 6 is detached from the printer body 2 (refer to FIG. 4), each component (the exposure device 10, the image forming part 11, the first conveying path 13, the cartridge sheet feeding part 14, the transferring part 15, the fixing device 16, the second conveying path 17, the manual bypass sheet feeding part 18 and others) inside the printer body becomes a state capable of maintenance, such as jam treatment. For example, a front side of the manual bypass sheet feeding part 18 is exposed in a case where the manual bypass tray 6 is at the open position, but is covered by the manual bypass tray 6 in a case where the manual bypass tray 6 is at the close position.

Next, image forming operation of the printer 1 including such a configuration will be described. In the printer 1, when image data is inputted and a printing start is directed from an external computer or the like connected with the printer 1, image forming operation is started. First, the surface of the photosensitive drum 12 is electrically charged by the charging device of the image forming part 11. Then, photographic exposure corresponding to the image data is carried out to the photosensitive drum 12 by a laser light (refer to a broken line P in FIG. 2) from the exposure device 10, and thereby, an electrostatic latent image is formed on the surface of the photosensitive drum 12. Next, the electrostatic latent image is developed to a toner image by the development device of the image forming part 11 using with the toner.

On the other hand, the sheet stored in the sheet feeding cartridge 4 is picked up by the cartridge sheet feeding part 14 and conveyed on the first conveying path 13. Alternatively, the sheet stacked on the manual bypass tray 6 is picked up by the manual bypass sheet feeding part 18 and conveyed on the second conveying path 17 and the first conveying path 13. By any of these ways, the sheet is conveyed to the transferring part 15 in a given timing. In the transferring part 15, the toner image on the photosensitive drum 12 is transferred onto the sheet. The sheet with the transferred toner image is conveyed to the fixing device 16.

In the fixing device 16, the toner image is fixed on the sheet. The sheet with the fixed toner image is ejected to the ejected sheet tray 5.

Figure 4:
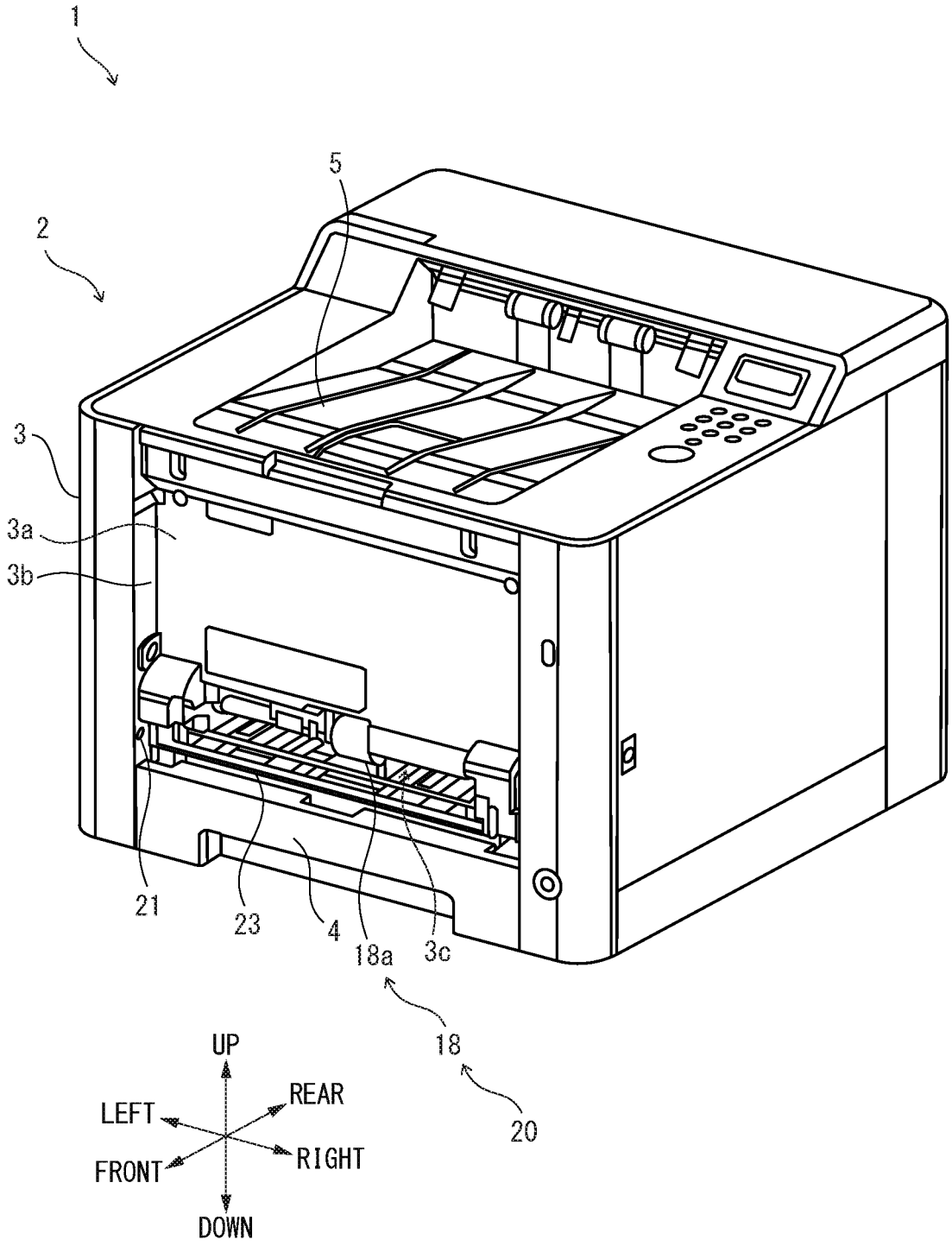
FIG. 4 is a perspective view showing the printer, as viewed from an upper side, in a state that the manual bypass tray is detached, according to the embodiment of the present disclosure.
Figure 5:
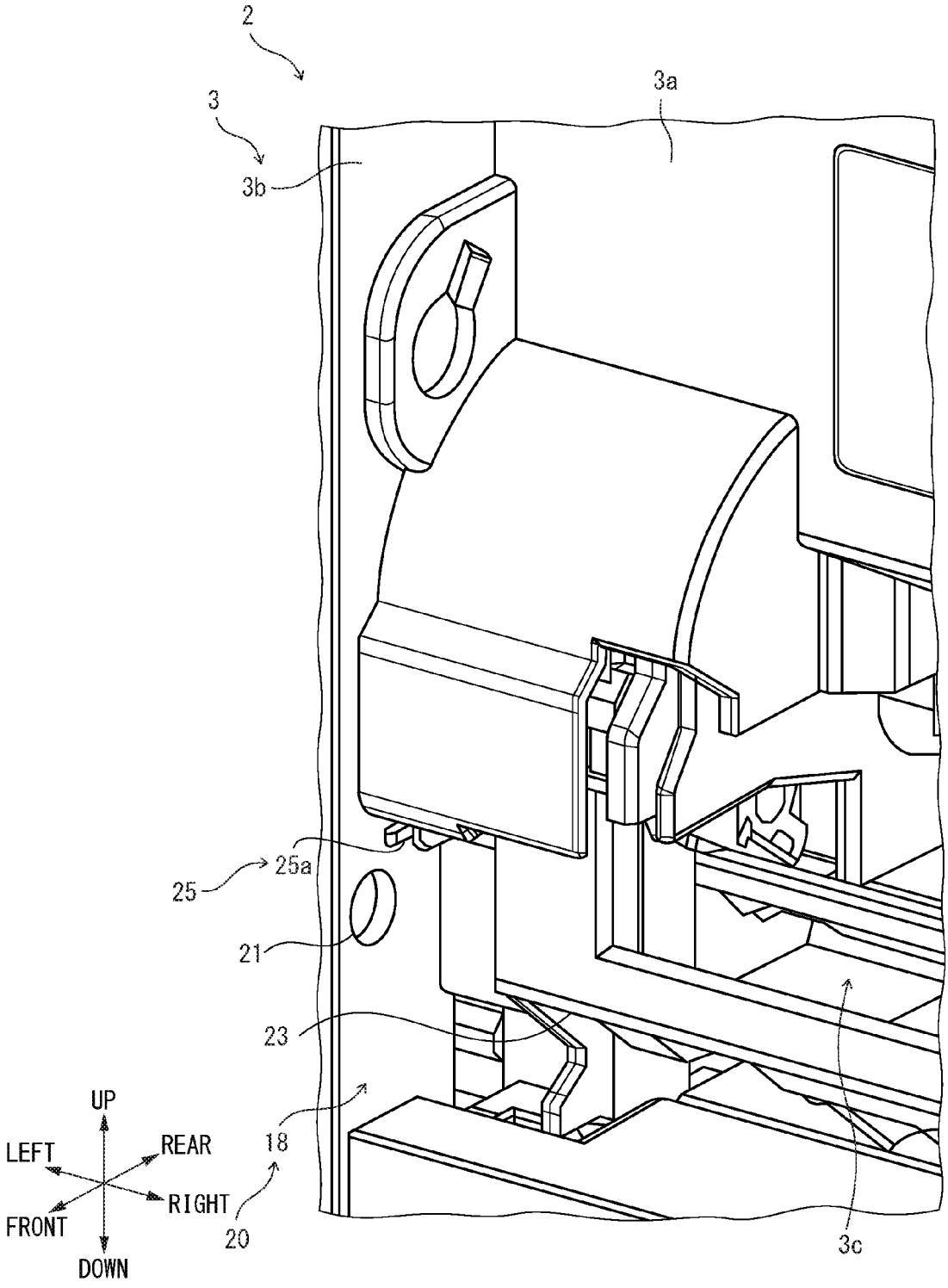
FIG. 5 is a perspective view showing a bearing of a storage recessed part in the printer according to the embodiment of the present disclosure.
Figure 10:
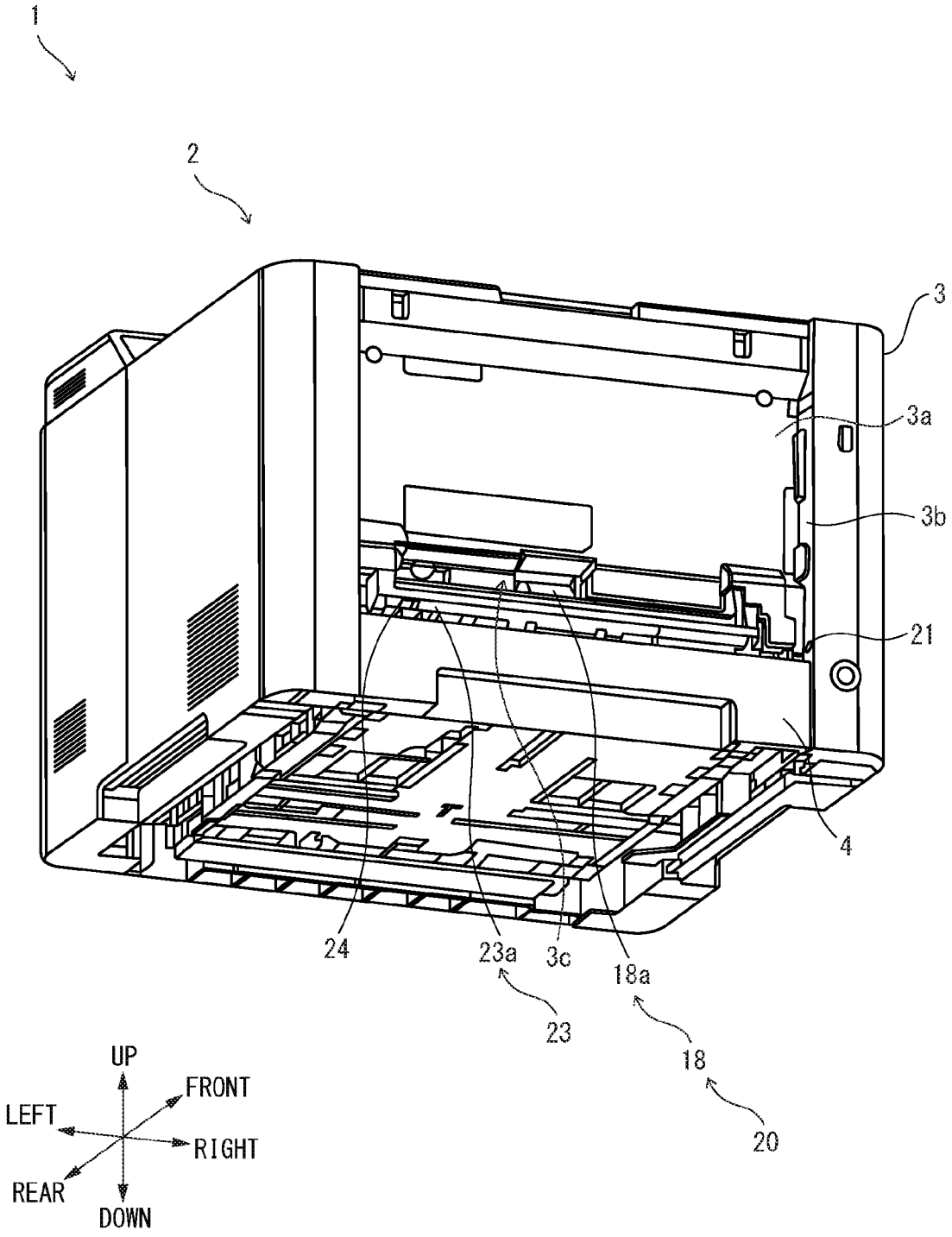
FIG. 10 is a perspective view showing the printer, as viewed from a lower side, in a state that the manual bypass tray is detached, according to the embodiment of the present disclosure.
Figure 11:
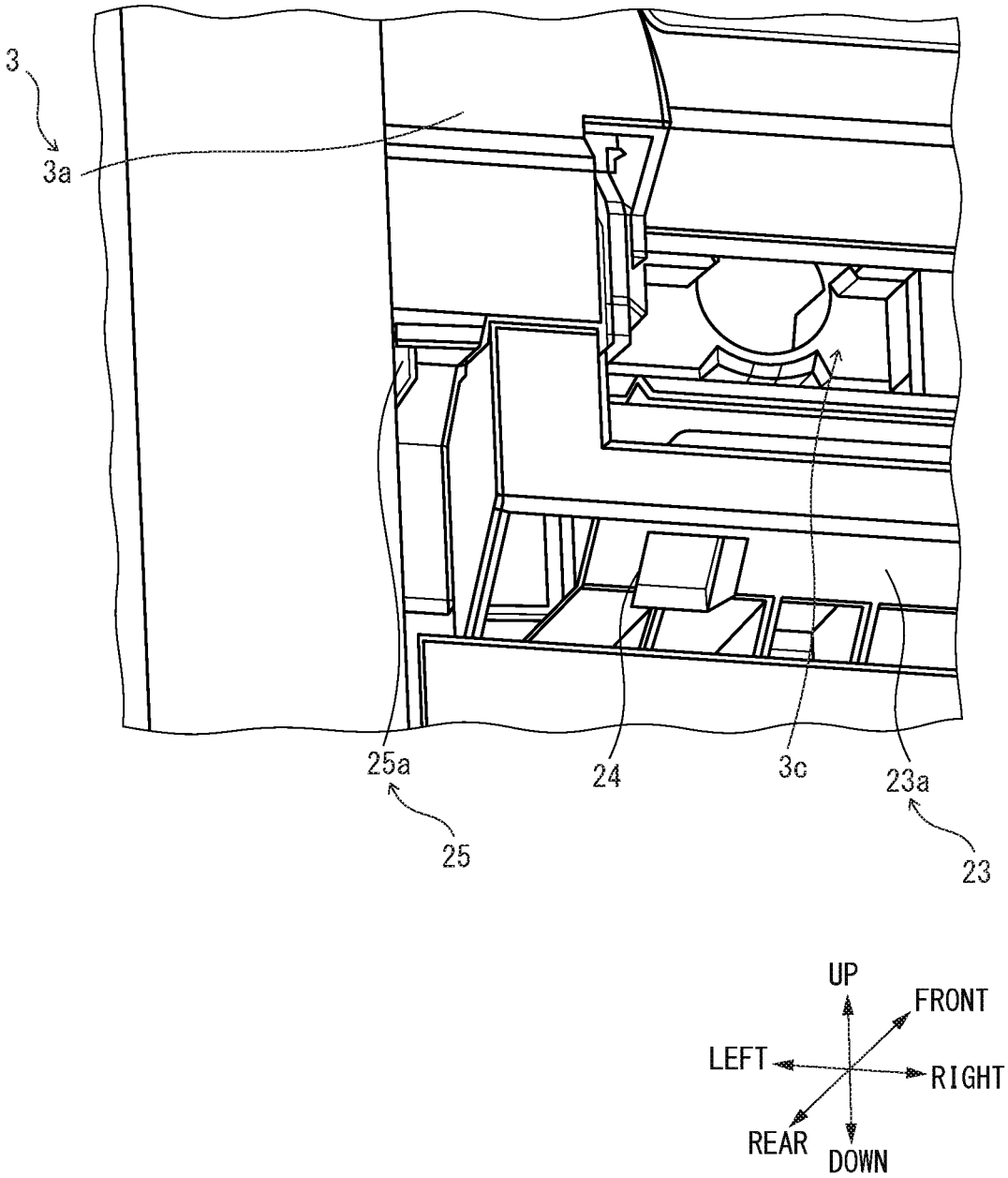
FIG. 11 is a perspective view showing the first positioning part provided in the storage recessed part, as viewed from the lower side, in the printer according to the embodiment of the present disclosure.

Next, the front cover 3 will be described. The front cover 3 has the left and right internal lateral faces 3*b* composing the storage recessed part 3*a*. In lower portions of the left and right internal lateral faces 3*b*, left and right bearings 21 (a turning fulcrum part) having an axis direction of the left and right directions are provided. Incidentally, the left internal lateral face 3*b* and the left bearing 21 are shown in FIGS. 4 and 5, and the right internal lateral face 3*b* and the right bearing 21 are shown in FIG. 10. The left and right bearings 21 support the manual bypass tray 6 in a turnable state and work as positioning holes positioning the manual bypass tray 6 in upward and downward directions and the forward and backward directions. The left and right bearings 21 are arranged, for example, above the feeding guide 23 and near the front side of the manual bypass sheet feeding part 18. According to positions of the left and right bearings 21, a feeding position of the sheet from the manual bypass tray 6 to the manual bypass sheet feeding part 18 is determined.

In addition, the front cover 3 includes left and right arms 22 supporting the manual bypass tray 6 at the open position in the left and right internal lateral faces 3*b*. The left and right arms 22 are link members linking the front cover 3 and the manual bypass tray 6 and define the angle of the manual bypass tray 6 at the open position. The left arm 22 is shown in FIG. 2 and the right arm 22 is not shown. The left and right arms 22 are arranged at a position not interfering the manual bypass tray 6 at the close position and are rotated simultaneously with turning of the manual bypass tray 6.

Further, as shown in FIGS. 4, 5, 10, 11 and other figures, the storage recessed part 3*a* of the front cover 3 has a sheet feeding port 3*c* opened toward the second conveying path 17 (in the inside of the device body) and supports the manual bypass sheet feeding part 18 inside the sheet feeding port 3*c*. At an upper side inside the sheet feeding port 3*c*, the sheet feeding roller 18*a* is arranged and, at a lower side inside the sheet feeding port 3*c*, the feeding guide 23 guiding the sheet to the second conveying path 17 is arranged. The feeding guide 23 is located so that an upper face thereof faces to a lower side of the sheet feeding roller 18*a*. A lower face of the feeding guide 23 is formed so that a front side thereof is inclined to an oblique upper side. The feeding guide 23 includes a first positioning part 24 at a left end (at a right side from the left bearing 21) of such an inclined face 23*a*. The first positioning part 24 is formed as a positioning recess part recessed toward an upper side, for example, formed so as to penetrate from a front lower side to a rear upper side. An inner circumference face of the first positioning part 24 as the positioning recess part is formed, for example, with expanding an opening edge (an inner circumference) so as to expand outwardly toward an opening. Incidentally, the inclined face 23*a* of the feeding guide 23 is arranged at least at lower side from the left and right bearings 21.

Figure 13:
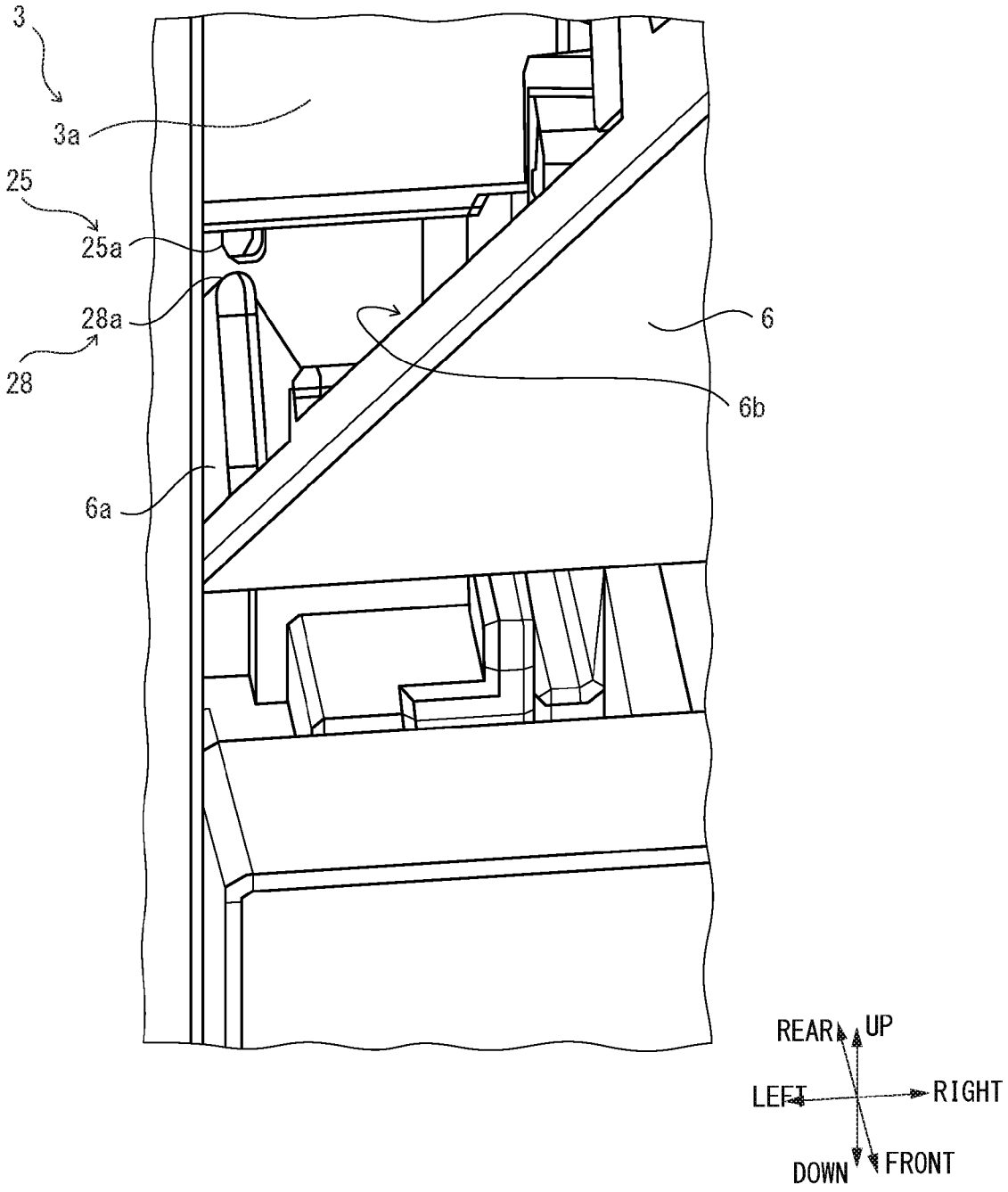
FIG. 13 is a perspective view showing a second positioned part of the storage recessed part and a second positioning part of the manual bypass tray in the printer according to the embodiment of the present disclosure.
Figure 14:
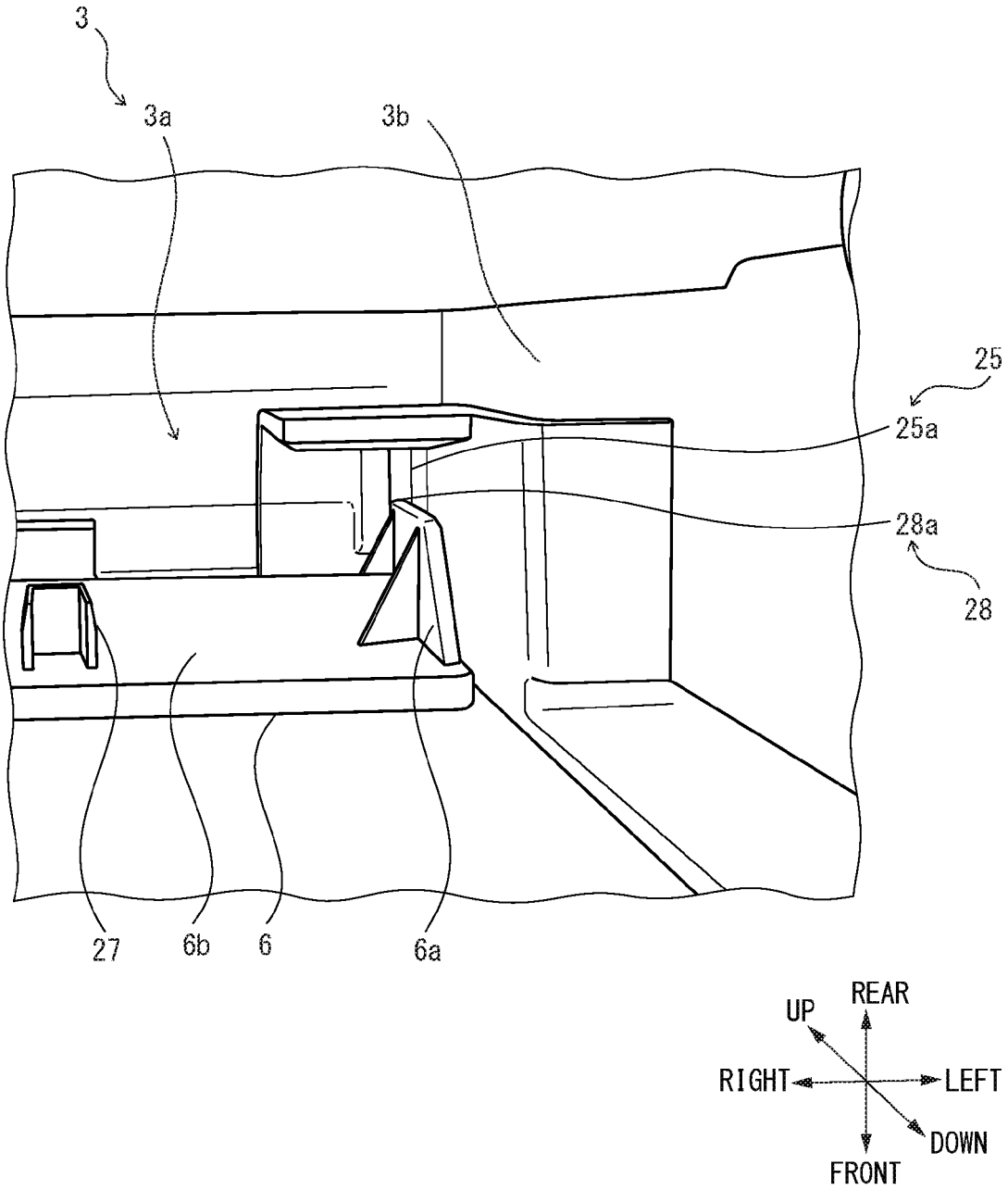
FIG. 14 is a perspective view showing the second positioned part fitted into the second positioning part, as viewed from the lower side, in the printer according to the embodiment of the present disclosure.
Figure 15:
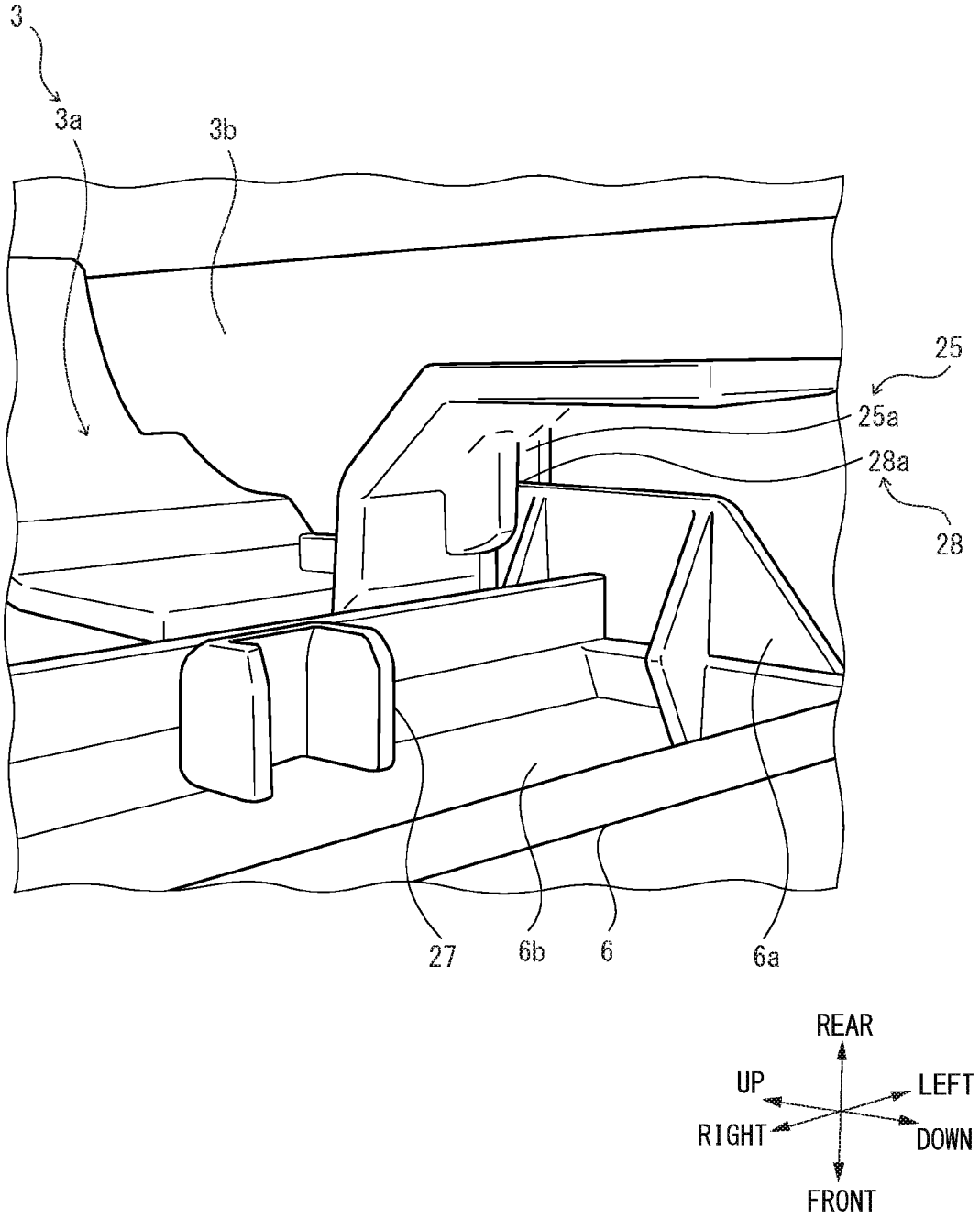
FIG. 15 is a perspective view showing the second positioned part fitted into the second positioning part, as viewed from a rear lower side, in the printer according to the embodiment of the present disclosure.

In addition, the storage recessed part 3*a* of the front cover 3 includes, as shown in FIGS. 13, 14 and 15, a second positioning part 25 at a slight upper side from the left bearing 21 on the left internal lateral face 3*b*. The second positioning part 25 has an engaging groove 25*a* formed from a front face thereof to a lower face thereof. The engaging groove 25*a* is recessed, for example, in parallel to the internal lateral face 3*b* of the front cover 3. Incidentally, the second positioning part 25 is produced integrally with the front cover 3. For example, the second positioning part 25 is composed of a pair of ribs and the engaging groove 25*a* is provided between the pair of ribs.

Figure 3:
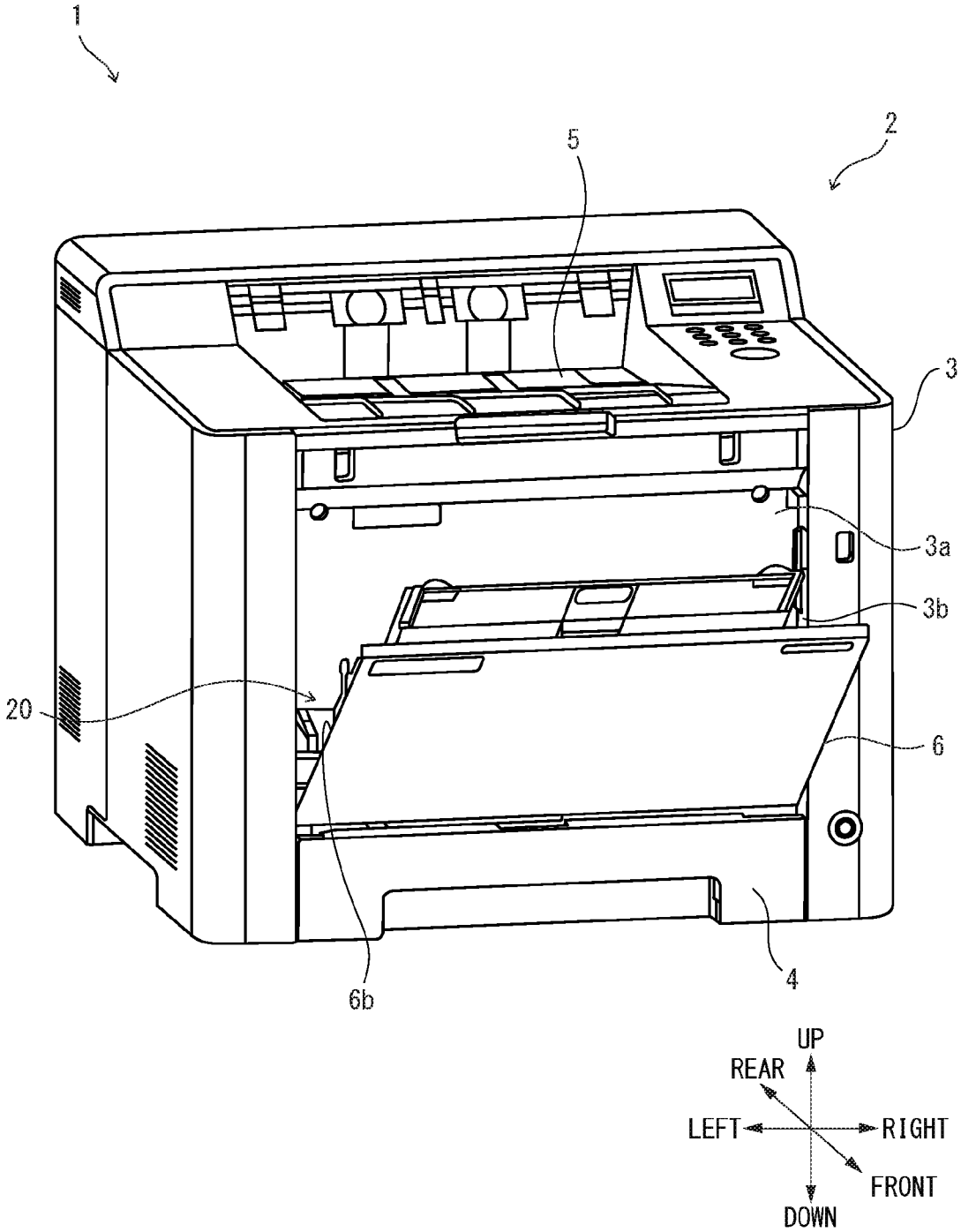
FIG. 3 is a perspective view showing the printer, in a state that a manual bypass tray is turned, according to the embodiment of the present disclosure.

Next, the manual bypass tray 6 will be described. The manual bypass tray 6 is, as shown in FIGS. 2 and 3, a plate-like member capable of being fitted into the storage recessed part 3*a* of the front cover 3. The manual bypass tray 6 has a facing surface 6*b* facing to the storage recessed part 3*a* so that the sheet can be stacked on the facing surface 6*b*. Hereinafter, it will be described so that a lower end of the manual bypass tray 6 in the erected state (a rear end of the manual bypass tray 6 in the laid state) is a proximal end of the manual bypass tray 6 and an upper end of the manual bypass tray 6 in the erected state (a front end of the manual bypass tray 6 in the laid state) is a distal end of the manual bypass tray 6. In other words, the proximal end of the manual bypass tray 6 is positioned at a downstream side in the conveyance direction of the stacked sheet and the distal end of the manual bypass tray 6 is positioned at an upstream side in the conveyance direction of the stacked sheet.

Figure 6:
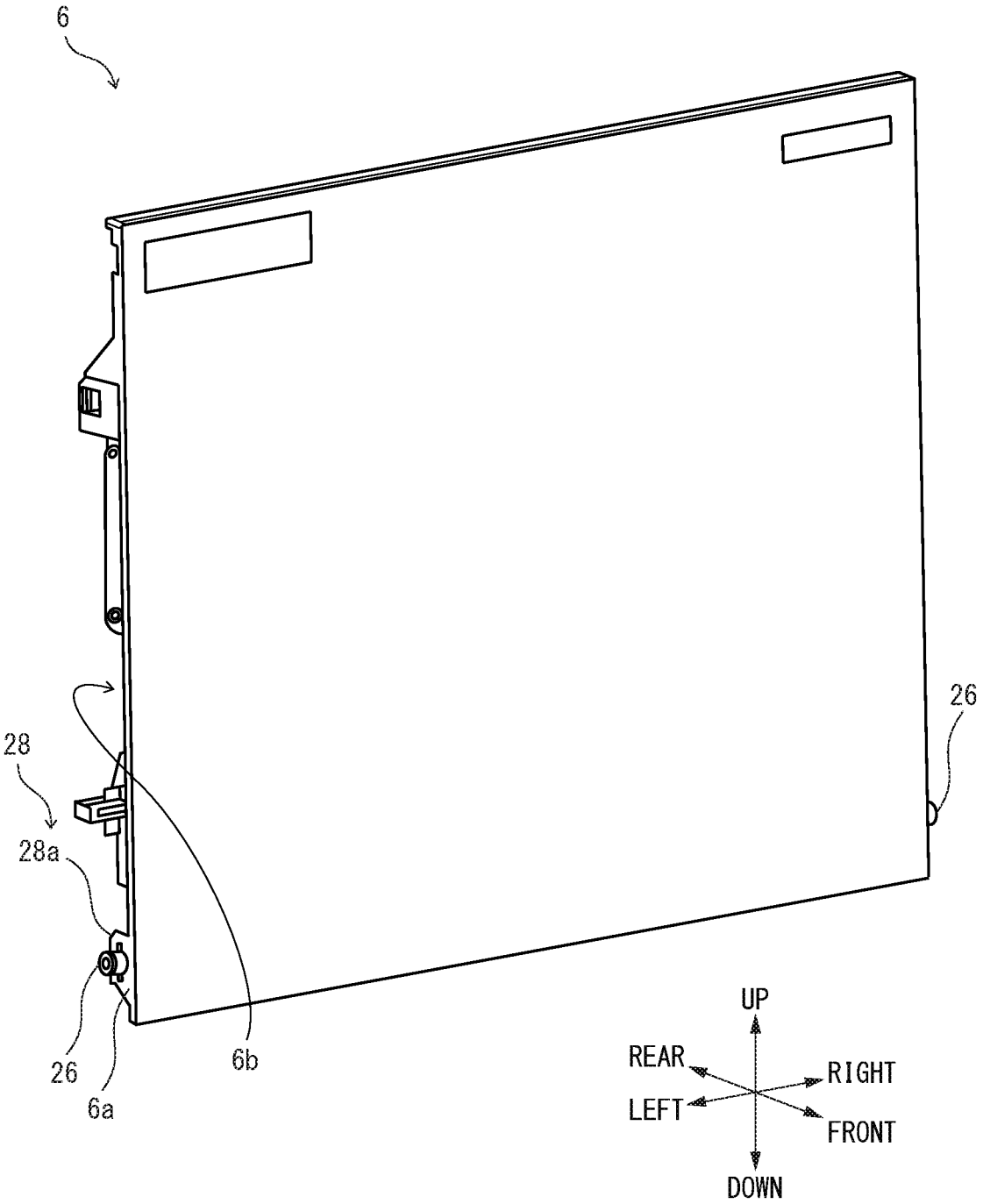
FIG. 6 is a perspective view showing the manual bypass tray in the printer according to the embodiment of the present disclosure.
Figure 7:
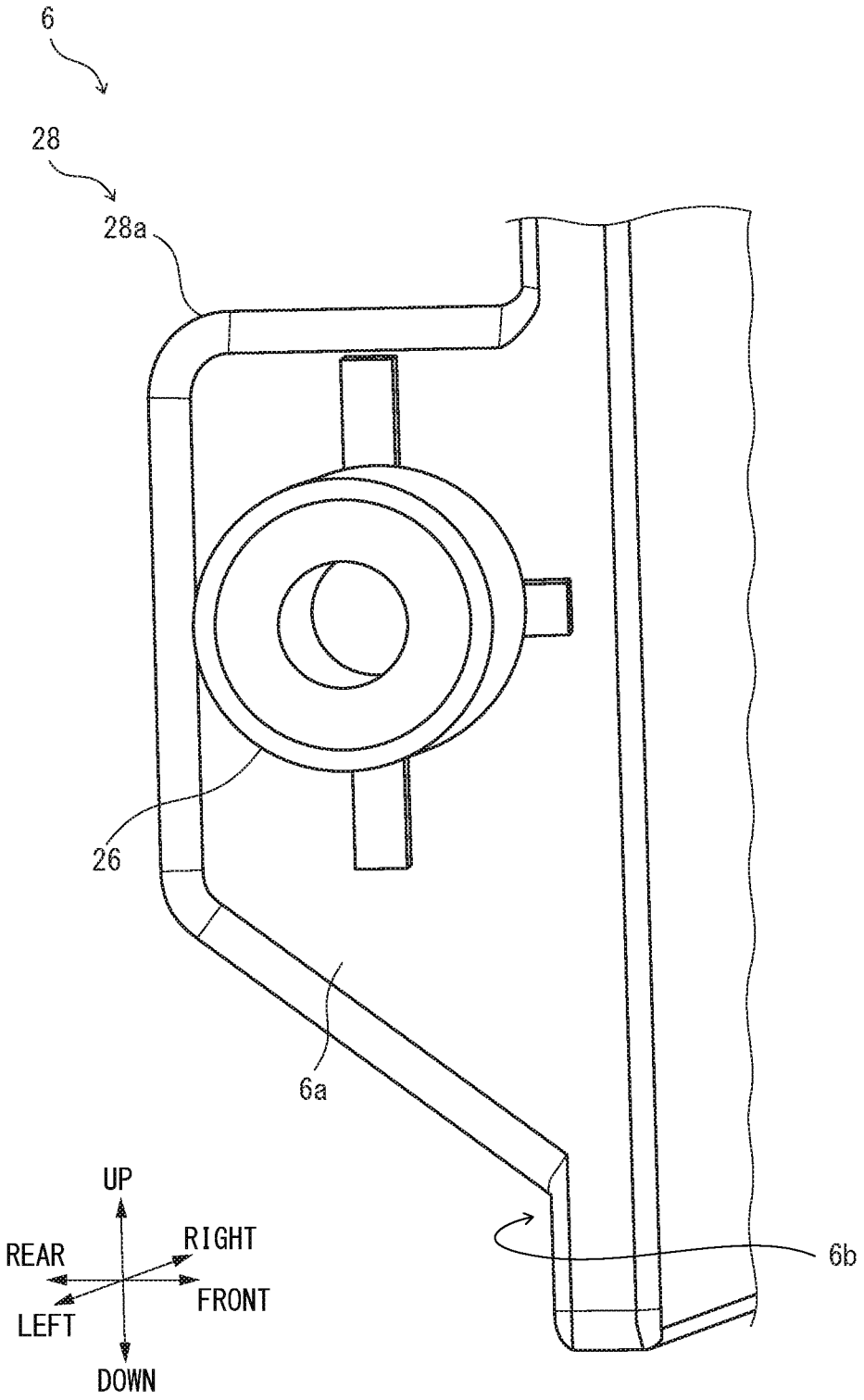
FIG. 7 is a perspective view showing a turning axis of the manual bypass tray in the printer according to the embodiment of the present disclosure.
Figure 8:
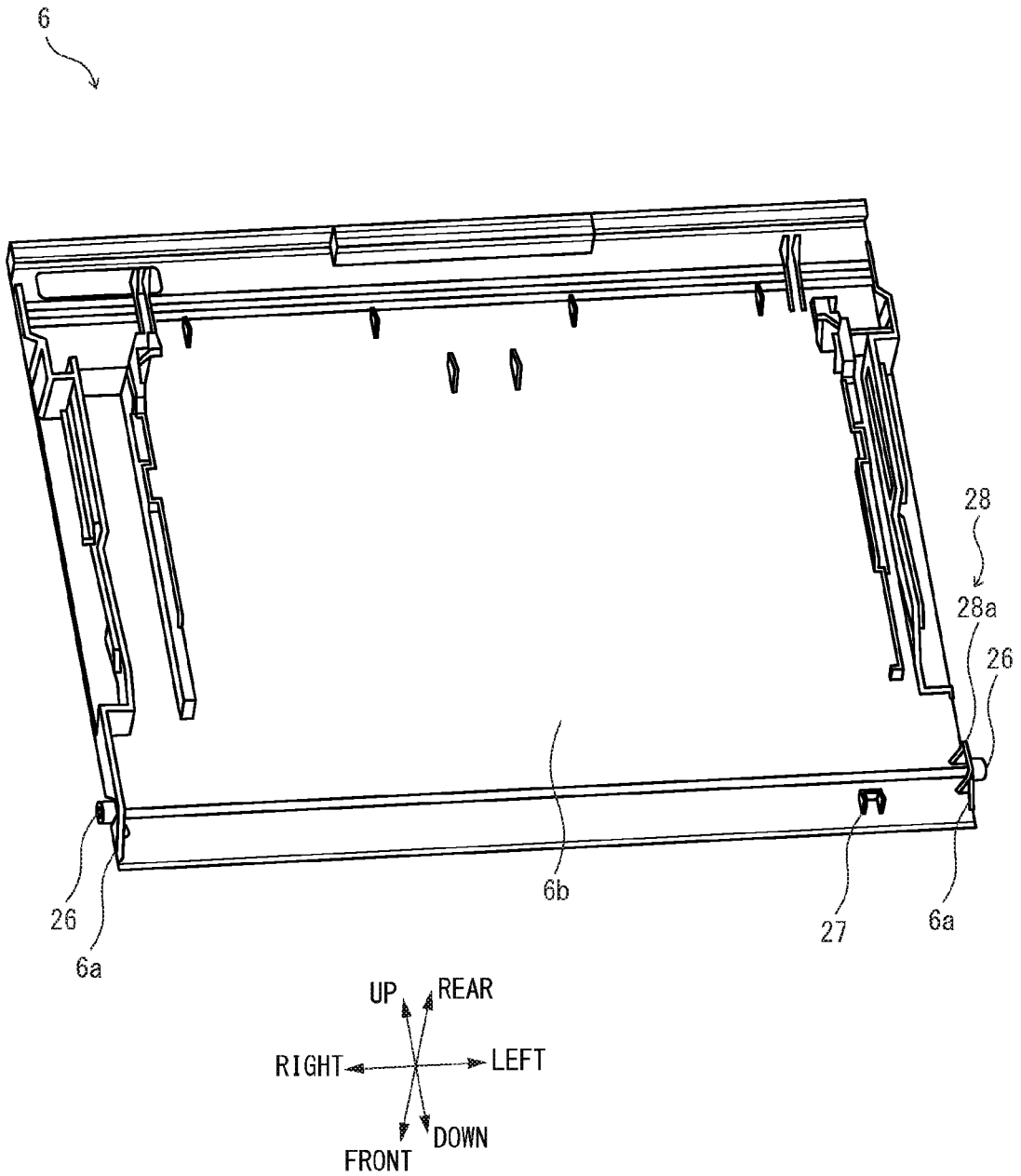
FIG. 8 is a perspective view showing the manual bypass tray as viewed from a back side in the printer according to the embodiment of the present disclosure.
Figure 9:
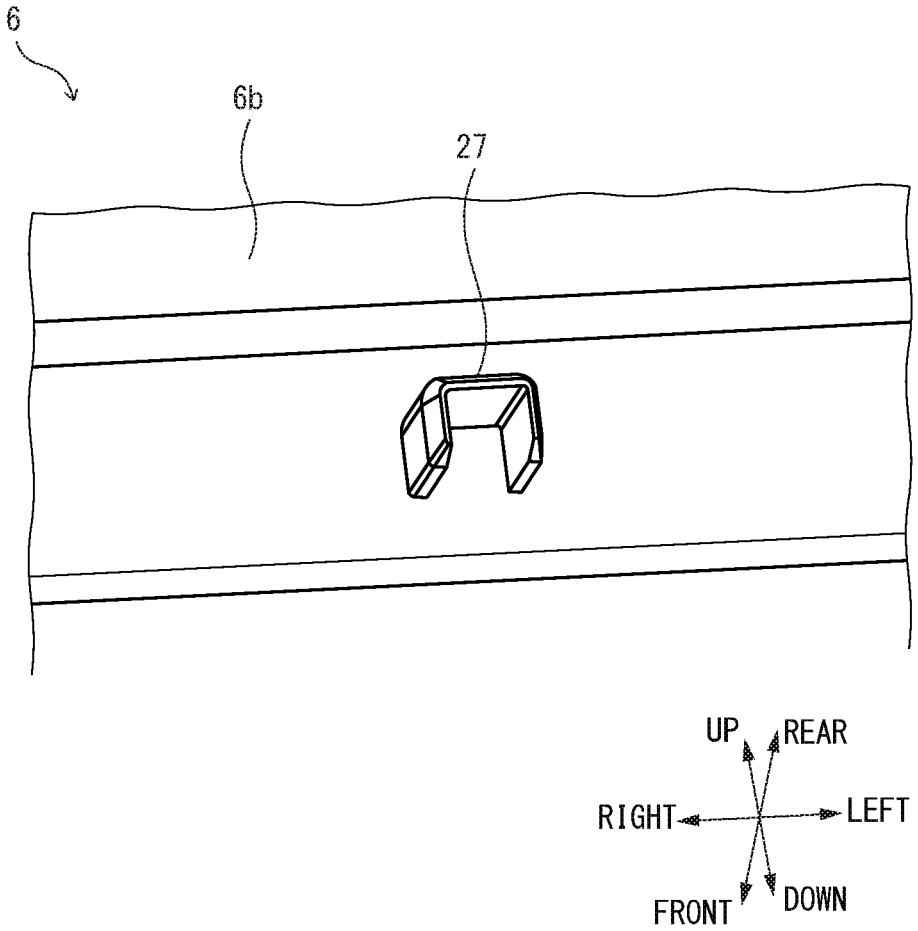
FIG. 9 is a perspective view showing a first positioned part provided in the manual bypass tray in the printer according to the embodiment of the present disclosure.

The manual bypass tray 6 includes left and right turning axes (rotational axes) 26 (a turning fulcrum part) having an axis direction of the left and right directions at left and right ends. Incidentally, the left turning axis 26 is shown in FIGS. 6, 7 and 8, and the right turning axis 26 is shown in FIGS. 6 and 8. The respective turning axes 26 are formed as positioning bosses protruded outwardly from left and right lateral faces 6*a* (tray lateral faces) of the manual bypass tray 6. The left and right lateral faces 6*a* of the manual bypass tray 6 are supporting walls standing (erected) in a vertical direction from the facing surface 6*b* of the manual bypass tray 6 and supporting the turning axes 26. Each turning axis 26 is arranged in the proximal end of the manual bypass tray 6, in other words, is located at the lower end of the manual bypass tray 6 in the erected state (the rear end of the manual bypass tray 6 in the laid state). The manual bypass tray 6 becomes turnable by attaching (inserting) the left and right turning axes 26 to the left and right bearings 21 of the storage recessed part 3*a*.

Figure 12A:
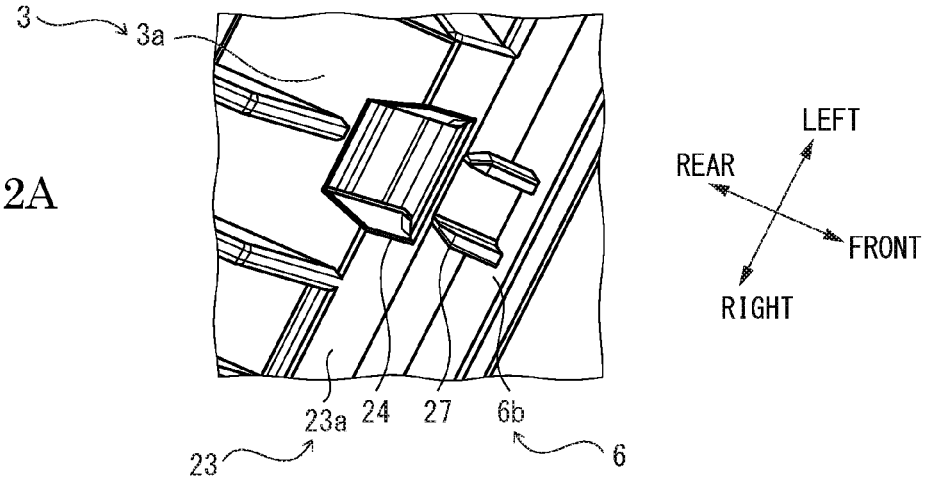
FIGS. 12A, 12B and 12C are perspective views showing the first positioned part fitted into the first positioning part, as viewed from the lower side, in the printer according to the embodiment of the present disclosure.

In addition, the manual bypass tray 6 includes a first positioned part 27 at a left end of a side of the proximal end from the left and right turning axes 26 (at a right side from the left turning axis 26). The first positioned part 27 is a positioned protrusion part protruded from the facing surface 6*b*, for example, is formed with a cross section of a reversed U-shape. The first positioned part 27 in a protruded shape is formed so that an outer circumference of a protruded distal end thereof is narrowed (tapered) in comparison with a side of a proximal end thereof. The first positioned part 27 has a shape fitting to the first positioning part 24 mutually and is arranged at a positioned corresponding to the first positioning part 24 mutually. FIG. 12A shows a state before the first positioned part 27 is fitted to the first positioning part 24, as viewed from a lower side. Incidentally, the first positioned part 27 is produced integrally with the manual bypass tray 6.

Figure 12B:
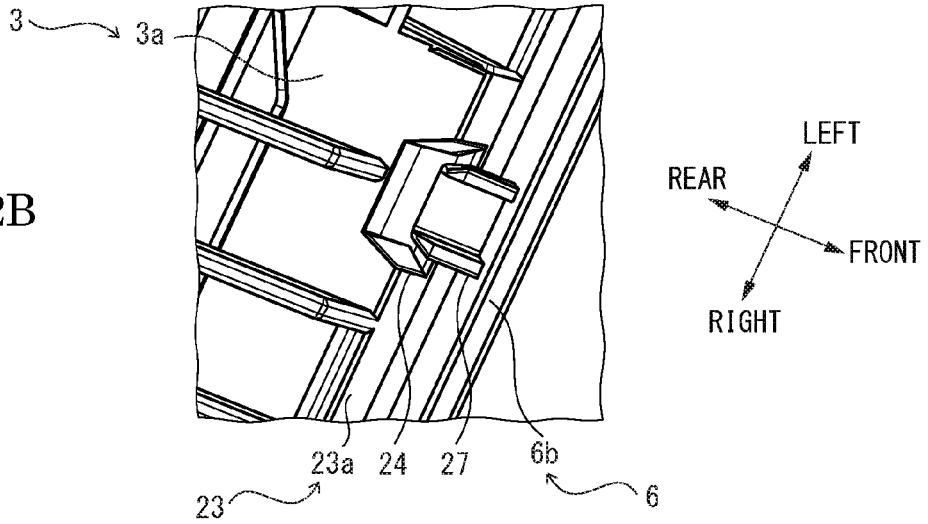
Figure 12C:
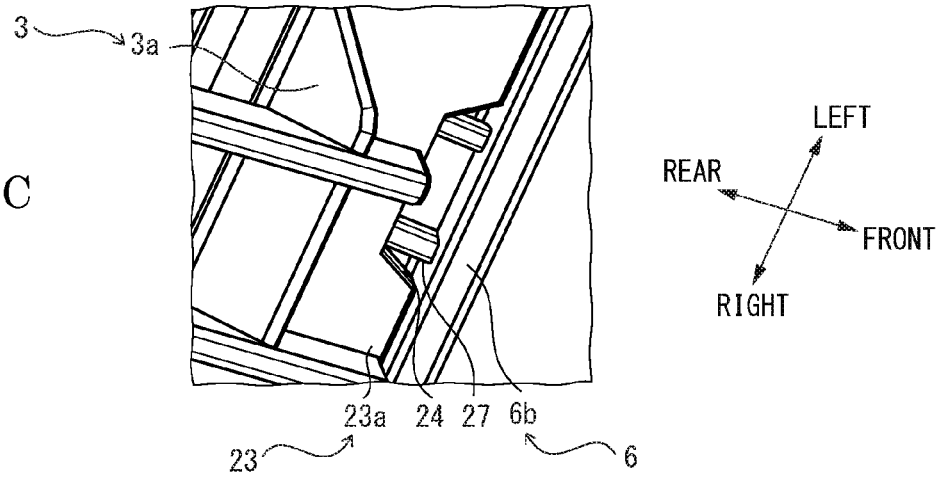

When the manual bypass tray 6 is turned from the close position to the open position, a side of the distal end of the manual bypass tray 6 from the turning axes 26 is turned (to a front side) so as to separate from the storage recessed part 3*a*. On the other hand, a side of the proximal end of the manual bypass tray 6 from the turning axes 26 is turned to the feeding guide 23, concretely is turned so as to go around to the lower face (the inclined face 23*a*) of the feeding guide 23 from a lower side. At this time, the first positioned part 27 of the manual bypass tray 6 is gradually inserted into the first positioning part 24 of the feeding guide 23 according to turning of the manual bypass tray 6. FIG. 12B shows a state while the first positioned part 27 is fitted to the first positioning part 24, as viewed from a lower side. Subsequently, when turning of the manual bypass tray 6 to the open position is finished, fitting of the first positioned part 27 to the first positioning part 24 is completed. FIG. 12C shows a state that fitting of the first positioned part 27 to the first positioning part 24 is completed, as viewed from a lower side.

Moreover, the manual bypass tray 6 includes, for example, as shown in FIGS. 13, 14 and 15, a left second positioned part 28 at a position corresponding to a proximal portion of the left turning axis 26. The second positioned part 28 includes at least an engaging piece 28*a* at a side of a distal end slightly from the center of each turning axis 26. The engaging piece 28*a* is provided, for example, in parallel to an upper side end (an upper end edge) of the (left) lateral face 6*a* of the manual bypass tray 6, in other words, is formed in an end of the lateral face 6*a* as the supporting wall supporting the turning axis 26. Incidentally, the engaging piece 28*a* of the second positioned part 28 has a shape fitting to the engaging groove 25*a* of the second positioning part 25 mutually and is arranged at a positioned corresponding to the engaging groove 25*a* mutually. Incidentally, the second positioned part 28 is produced integrally with the manual bypass tray 6.

When the manual bypass tray 6 is turned from the open position to the close position, the side of the distal end of the manual bypass tray 6 from the turning axes 26 is turned to the storage recessed part 3*a* (to a rear side). At this time, the engaging piece 28*a* of the second positioned part 28 of the manual bypass tray 6 is gradually inserted into the engaging groove 25*a* of the second positioning part 25 of storage recessed part 3*a* according to turning of the manual bypass tray 6. Subsequently, when turning of the manual bypass tray 6 to the close position is finished, as shown in FIGS. 14 and 15, fitting (engaging) of the engaging piece 28*a* of the second positioned part 28 with the engaging groove 25*a* of the second positioning part 25 is completed. Incidentally, when the manual bypass tray 6 is turned from the close position to the open position, the engaging piece 28*a* of the second positioned part 28 is released from the engaging groove 25*a* of the second positioning part 25.

In accordance with the embodiment, as described above, the sheet feeding device 20 applied to the printer (the image forming apparatus) includes the storage recessed part 3*a* (the side face of the device body) of the front cover 3 and the manual bypass tray 6 (the bypass tray). The manual bypass tray 6 is supported so as to be turned around the turning axes 26 (the turning fulcrum part) between the close position along the storage recessed part 3*a* and the open position being held at a predetermined angle with respect to the storage recessed part 3*a*. The manual bypass tray 6 includes the facing surface 6*b* and the first positioned part 27. The facing surface 6*b* faces to the storage recessed part 3*a* in the close position and is capable of stacking the sheet in the open position. The first positioned part 27 is arranged on the facing surface 6*b* below the turning axes 26. The first positioning part 24 is fitted with the first positioned part 27 in the open position to restrict movement of the manual bypass tray 6 in the width direction.

For example, the storage recessed part 3*a* includes the sheet feeding port 3*c* opened toward the inside of the device, the sheet feeding roller 18*a* (the feeding part) arranged in the sheet feeding port 3*c* to feed the sheet to the inside of the device, and the feeding guide 23 arranged so that the upper face thereof faces to the lower side of the sheet feeding roller 18*a* and guiding the sheet to the sheet feeding port 3*c*. The first positioning part 24 is formed on the lower face of the feeding guide 23.

According to such a configuration, when the manual bypass tray 6 is positioned at the open position to become capable of stacking the sheet on the manual bypass tray 6, the first positioning part 24 of the storage recessed part 3*a* (the feeding guide 23) and the first positioned part 27 of the manual bypass tray 6 are fitted to each other. Accordingly, when the sheet is fed from the manual bypass tray 6, the manual bypass tray 6 can be securely positioned with respect to the storage recessed part 3*a* (the feeding guide 23) in the sheet width direction (an orthogonal direction to the sheet conveyance direction). Therefore, it is possible to restrain backlash amount in the sheet width direction (a thrust direction) of the manual bypass tray 6 regardless of tolerance of the storage recessed part 3*a* or the feeding guide 23 and the manual bypass tray 6. Further, it is possible to prevent skew when the sheet is fed from the manual bypass tray 6 and to excellently maintain sheet feeding performance.

In addition, in accordance with the embodiment, the first positioned part 27 is the positioned protrusion part formed so as to be protruded from the facing surface 6*b* and so that the outer circumference of the protruded distal end is narrowed (tapered) in comparison with the side of the proximal end. The first positioning part 24 is the positioning recess part engaging with the positioned protrusion part. The positioning recess part includes the inner circumference face and the opening toward the positioned protrusion part, and the inner circumference face is expanded outwardly toward the opening.

Thereby, if the first positioning part 24 as the positioning recess part and the first positioned part 27 as the positioned protrusion part are configured in small dimensions, it is possible to restrain dimension tolerance. Moreover, when fitting of the first positioning part 24 and the first positioned part 27 is started, since the reduced distal end is inserted into the expanded opening, it is possible to guide the positioned protrusion part to the positioning recess part without interference, to facilitate fitting of the positioned protrusion part and the positioning recess part, and to reduce damage due to interference of both of such components.

Further, in accordance with the embodiment, the manual bypass tray 6 includes the second positioned part 28 at the left side (one end side) in the sheet width direction. The storage recessed part 3*a* includes the second positioning part 25 fitting (engaging) with the second positioned part 28 at the position corresponding to the second positioned part 28 of the manual bypass tray 6 in the close position.

For example, the manual bypass tray 6 includes the left and right lateral faces 6*a* (the tray lateral faces) standing (erected) in the vertical direction with respect to the facing surface 6*b* at the lower sides of both sides in the width direction. The second positioned part 28 includes the engaging pieces 28*a* provided in the upper end edges of the lateral faces 6*a* (in FIGS. 13 and 14, the left side (one end side) is shown). The second positioning part 25 includes the engaging groove 25*a* formed in the storage recessed part 3*a* and capable of engaging with the engaging piece 28*a*.

Thereby, the sheet feeding device 20 can have a mechanism positioning the manual bypass tray 6 at the close position with respect to the storage recessed part 3*a* in the sheet width direction, in addition to a mechanism positioning the manual bypass tray 6 at the open position with respect to the storage recessed part 3*a* in the sheet width direction. Therefore, it is possible to restrain vibration of the manual bypass tray 6 in a case where the manual bypass tray 6 is not used.

Moreover, in accordance with the embodiment, the turning fulcrum part of the manual bypass tray 6 is the turning axes 26. The left and right lateral faces 6*a* of the manual bypass tray 6 are supporting walls supporting the turning axes 26.

Thereby, it is possible to form the engaging piece 28*a* of the second positioned part 28 by using the lateral face 6*a* as the supporting wall supporting the turning axis 26. Therefore, it is possible to simply provide the engaging piece 28*a* without providing other components.

Although, in the above-described embodiment, a configuration arranging the manual bypass tray 6 in the storage recessed part 3*a* as the side face of the device body at the front side of the sheet feeding device 20 was described, the position where the manual bypass tray 6 is arranged is not restricted by this. For example, the manual bypass tray 6 may be arranged on another storage recessed part as another side face of the device body at a back side or left or right side of the sheet feeding device 20.

Although, in the above-described embodiment, a turning mechanism of the manual bypass tray 6 including the bearings 21 arranged in the storage recessed part 3*a* and the turning axes 26 arranged in the manual bypass tray was described, the turning mechanism of the manual bypass tray 6 is not restricted by this. For example, in another embodiment, the turning mechanism of the manual bypass tray 6 may include turning axes arranged in the storage recessed part 3*a* and bearings arranged in the manual bypass tray 6.

Although, in the above-described embodiment, a configuration arranging the bearings 21 in the storage recessed part 3*a* was described, the configuration of the bearings 21 is not restricted by this. For example, in another embodiment, the bearings 21 may be arranged in another member, such as an internal frame of the printer body 2 or a special frame to the sheet feeding device 20.

Although, in the above-described embodiment, a configuration arranging the first positioning part 24 in the feeding guide 23 of the manual bypass sheet feeding part 18 was described, the configuration of the first positioning part 24 is not restricted by this. For example, in another embodiment, it is sufficient that the first positioning part 24 is a member positioning the manual bypass sheet feeding part 18, and accordingly, the first positioning part 24 may be arranged on another member, such as an internal frame of the printer body 2 or a special frame to the sheet feeding device 20.

Although, in the above-described embodiment, a configuration that the first positioning part 24 is the positioning recess part and the first positioned part 27 is the positioned protrusion part was described, shapes of the first positioning part 24 and the first positioned part 27 are not restricted by these. For example, in another embodiment, the first positioning part 24 may be a positioning protrusion part and the first positioned part 27 may be a positioned recess part. In other words, in the sheet feeding device in another embodiment, the first positioned part 27 may be formed as the positioned recess part including an inner circumference face and an opening so that the inner circumference face is expanded outwardly toward the opening. The first positioning part 24 may be formed as the positioning protrusion part protruded from the storage recessed part 3*a* (the feeding guide 23) so that an outer circumference of a protruded distal end is narrowed (tapered) in comparison with a side of a proximal end. Thereby, if the first positioning part 24 and the first positioned part 27 are configured in small dimensions, it is possible to restrain dimension tolerance. Moreover, when fitting of the first positioning part 24 and the first positioned part 27 is started, since the reduced distal end is inserted into the expanded opening, it is possible to guide the positioning protrusion part to the positioned recess part without interference, to facilitate fitting of the positioned protrusion part and the positioning recess part, and to reduce damage due to interference of both of such components. Alternatively, because it is sufficient to fit the first positioning part 24 and the first positioned part 27 with each other, the first positioning part 24 and the first positioned part 27 may be formed in other shapes. Further, although, in the above-described embodiment, a configuration that the first positioning part 24 and the first positioned part 27 are provided one by one was described, in another embodiment, two or more pairs of the first positioning part 24 and the first positioned part 27 may be provided.

Although, in the above-described embodiment, a configuration that the second positioning part 25 includes the engaging groove 25*a* and the second positioned part 28 includes the engaging piece 28*a* was described, the configuration of the second positioning part 25 and the second positioned part 28 is not restricted by this. For example, in another embodiment, the second positioning part 25 may include an engaging piece and the second positioned part 28 may include an engaging groove. In other words, in the sheet feeding device in another embodiment, the second positioning part 25 may include the engaging piece arranged in parallel to the internal lateral face 3*b* standing (erected) in a vertical direction from the storage recessed part 3*a*. The second positioned part 28 may include the engaging groove formed in the manual bypass tray 6 (the facing surface 6*b*) and capable of engaging with the engaging piece. Alternatively, because it is sufficient to fit the second positioning part 25 and the second positioned part 28 with each other, the second positioning part 25 and the second positioned part 28 may be formed in other shapes. Further, in another embodiment, the second positioning part 25 and the second positioned part 28 may configured so as to be fitted with each other at a lower side from the center of the turning axes 26 when the manual bypass tray 6 is at the open position, in addition to a configuration fitting with each other at an upper side from the center of the turning axes 26 when the manual bypass tray 6 is at the close position. Moreover, although, in the above-described embodiment, a configuration that the second positioning part 25 and the second positioned part 28 are provided one by one at the left side was described, in another embodiment, two pairs of the second positioning part 25 and the second positioned part 28 may be provided at the left and right sides.

The embodiment was described in a case of applying the configuration of the present disclosure to the printer 1. On the other hand, in another embodiment, the configuration of the disclosure may be applied to another image forming apparatus, such as a copying machine, a facsimile or a multifunction peripheral.

Further, the above-description of the embodiments was described about one example of the image forming apparatus including this according to the present disclosure. However, the technical scope of the present disclosure is not limited to the embodiments. Components in the embodiment described above can be appropriately exchanged with existing components, and various variations including combinations with other existing components are possible. The description of the embodiment described above does not limit the content of the disclosure described in the claims.

The invention claimed is:

1. A sheet feeding device comprising:

a side face of a device body; and a bypass tray supported so as to be turned around a turning fulcrum part with respect to the side face between a close position along the side face and an open position being held at a predetermined angle with respect to the side face, wherein the bypass tray includes a facing surface facing to the side face in the close position and being capable of stacking the sheet in the open position; and a first positioned part arranged on the facing surface below the turning fulcrum part, the side face includes a first positioning part being fitted with the first positioned part in the open position to restrict movement of the bypass tray in the width direction, the first positioned part is a positioned protrusion part formed so as to protrude from the facing surface and so that an outer circumference of a distal end thereof is narrowed in comparison with a proximal end side thereof, the first positioning part is a positioning recess part engaging with the positioned protrusion part, the positioning recess part includes an inner circumference face and an opening toward the positioned protrusion part, and the inner circumference face is expanded outwardly toward the opening.

2. The sheet feeding device according to claim 1, wherein the side face includes:

a sheet feeding port opened toward the inside of the device body;

a feeding part arranged in the sheet feeding port to feed the sheet to the inside of the device body; and a feeding guide arranged so that an upper face thereof faces to a lower side of the feeding part and guiding the sheet to the sheet feeding port, the first positioning part is formed on a lower face of the feeding guide.

3. A sheet feeding device comprising:

a side face of a device body; and a bypass tray supported so as to be turned around a turning fulcrum part with respect to the side face between a close position along the side face and an open position being held at a predetermined angle with respect to the side face, wherein the bypass tray includes a facing surface facing to the side face in the close position and being capable of stacking the sheet in the open position; and a first positioned part arranged on the facing surface below the turning fulcrum part, the side face includes a first positioning part being fitted with the first positioned part in the open position to restrict movement of the bypass tray in the width direction, the first positioning part is a positioning protrusion part formed so as to protrude from the side face and so that an outer circumference of a distal end thereof is narrowed in comparison with a proximal end side thereof, the first positioned part is a positioned recess part engaging with the positioning protrusion part, the positioned recess part includes an inner circumference face and an opening toward the positioning protrusion part, and the inner circumference face is expanded outwardly toward the opening.

4. The sheet feeding device according to claim 1, wherein the bypass tray includes a second positioned part at one end side in the width direction, the side face includes a second positioning part engaging with the second positioned part at a position corresponding to the second positioned part in the close position.

5. The sheet feeding device according to claim 4, wherein the bypass tray includes lateral faces of tray standing in a vertical direction with respect to the facing surface at lower sides of both sides in the width direction, the second positioned part includes engaging pieces respectively provided in upper end edges of the lateral faces, the second positioning part includes an engaging groove formed in the side face and capable of engaging with the engaging piece.

6. The sheet feeding device according to claim 5, wherein the turning fulcrum part is rotational axes, the lateral faces are supporting walls supporting the rotational axes.

7. The sheet feeding device according to claim 4, wherein the second positioning part includes an engaging piece standing in a vertical direction from the side face, the second positioned part includes an engaging groove formed in the facing surface and capable of engaging with the engaging piece.

8. The sheet feeding device according to claim 1, wherein the side face includes a storage recessed part of a front cover of an image forming apparatus provided with the sheet feeding device, the bypass tray is stored in the storage recessed part.

9. An image forming apparatus comprising:

the sheet feeding device according to claim 1;

a bypass sheet feeding part provided with the sheet feeding device; and an image forming part forming an image on the sheet fed from the sheet feeding device.

10. An image forming apparatus comprising:

the sheet feeding device according to claim 2;

a bypass sheet feeding part provided with the sheet feeding device; and an image forming part forming an image on the sheet fed from the sheet feeding device.

11. An image forming apparatus comprising:

the sheet feeding device according to claim 3;

a bypass sheet feeding part provided with the sheet feeding device; and an image forming part forming an image on the sheet fed from the sheet feeding device.

12. An image forming apparatus comprising:

the sheet feeding device according to claim 4;

a bypass sheet feeding part provided with the sheet feeding device; and an image forming part forming an image on the sheet fed from the sheet feeding device.

13. An image forming apparatus comprising:

the sheet feeding device according to claim 5;

a bypass sheet feeding part provided with the sheet feeding device; and an image forming part forming an image on the sheet fed from the sheet feeding device.

14. An image forming apparatus comprising:

the sheet feeding device according to claim 6;

a bypass sheet feeding part provided with the sheet feeding device; and an image forming part forming an image on the sheet fed from the sheet feeding device.

15. An image forming apparatus comprising:

the sheet feeding device according to claim 7;

a bypass sheet feeding part provided with the sheet feeding device; and an image forming part forming an image on the sheet fed from the sheet feeding device.

16. An image forming apparatus comprising:

the sheet feeding device according to claim 8;

a bypass sheet feeding part provided with the sheet feeding device; and an image forming part forming an image on the sheet fed from the sheet feeding device.

17. The sheet feeding device according to claim 3, wherein the side face includes:

a sheet feeding port opened toward the inside of the device body;

a feeding part arranged in the sheet feeding port to feed the sheet to the inside of the device body; and a feeding guide arranged so that an upper face thereof faces to a lower side of the feeding part and guiding the sheet to the sheet feeding port, the first positioning part is formed on a lower face of the feeding guide.

18. The sheet feeding device according to claim 3, wherein the bypass tray includes a second positioned part at one end side in the width direction, the side face includes a second positioning part engaging with the second positioned part at a position corresponding to the second positioned part in the close position.

* * * * *